United States Patent [19]

Smith

[11] Patent Number: 4,641,110

[45] Date of Patent: Feb. 3, 1987

[54] SHIELDED RADIO FREQUENCY TRANSMISSION CABLE HAVING PROPAGATION CONSTANT ENHANCING MEANS

[75] Inventor: Kenneth L. Smith, Amesbury, Mass.

[73] Assignee: Adams-Russell Company, Inc., Amesbury, Mass.

[21] Appl. No.: 620,121

[22] Filed: Jun. 13, 1984

[51] Int. Cl.[4] ..... H01P 3/06

[52] U.S. Cl. ..... 333/12; 333/243; 174/36

[58] Field of Search ..... 333/1, 12, 236, 243; 174/32, 36, 105 R, 106 R, 109

[56] References Cited

U.S. PATENT DOCUMENTS

| | | | |
|---|---|---|---|
| 2,576,163 | 11/1951 | Weston et al. | 174/36 X |
| 2,769,149 | 10/1956 | Kreer Jr. | 333/243 |
| 3,032,604 | 5/1962 | Timmons | 174/115 |
| 3,484,679 | 12/1969 | Hodgson et al. | 333/243 X |
| 3,666,877 | 5/1972 | Arnaudin, Jr. et al. | 174/115 |
| 3,870,977 | 3/1975 | Peoples et al. | 333/237 |
| 3,949,329 | 4/1976 | Martin | 333/237 |
| 3,963,854 | 6/1976 | Fowler | 174/106 R X |
| 4,041,237 | 8/1977 | Stine et al. | 174/36 |
| 4,096,346 | 6/1978 | Stine et al. | 174/36 |
| 4,157,518 | 6/1979 | McCarthy | 333/237 |
| 4,250,351 | 2/1981 | Bridges | 174/106 R |
| 4,323,721 | 4/1982 | Kincaid et al. | 174/36 |
| 4,327,246 | 4/1982 | Kincaid | 174/36 |
| 4,339,733 | 7/1982 | Smith | 333/237 |
| 4,376,920 | 3/1983 | Smith | 333/12 |
| 4,477,693 | 10/1984 | Kralec et al. | 174/106 R X |

FOREIGN PATENT DOCUMENTS

| | | | |
|---|---|---|---|
| 2428895 | 2/1980 | France | 174/36 |
| 2514189 | 4/1983 | France | 174/109 |
| 2520548 | 7/1983 | France | 174/109 |
| 2088117 | 6/1982 | United Kingdom | 174/36 |
| 2106306 | 4/1983 | United Kingdom | 174/36 |

*Primary Examiner*—Eugene R. LaRoche
*Assistant Examiner*—Benny Lee

[57] ABSTRACT

An improved shielded radio frequency transmission cable having at least one center conductor surrounded by a dielectric and a plurality of metallic sheaths surrounding the dielectric with at least two of the metallic sheaths separated by at least one interlayer (preferably braided) that includes insulating material (which may be a good dielectric) and at least one conducting member.

23 Claims, 8 Drawing Figures

SHIELDED RADIO FREQUENCY TRANSMISSION CABLE HAVING PROPAGATION CONSTANT ENHANCING MEANS

BACKGROUND OF THE INVENTION

This invention relates to shielded radio frequency transmission cable, and particularly to improvements in apparatus, techniques, and materials for the type of shielded radio frequency transmission cable disclosed in Smith, U.S. Pat. No. 4,375,920.

The specification of the Smith patent describes a well shielded cable having at least one center conductor, a dielectric surrounding the center conductor to establish a primary transmission path, and at least two metallic sheaths separated to provide a high series impedance. The space between the sheaths is occupied by an extruded dielectric interlayer and the materials, configuration, and sizes of the sheaths and the dielectric interlayer are selected to establish a high propagation function (propagation constant) for the second transmission path that results between the sheaths. In particular, Smith's specification discloses attaining the desired high propagation function by special features of the sheaths and/or the dielectric, i.e., by (1) proper selection of the resistance and inductance of at least one of the sheaths and the electrical properties of the dielectric, (2) using a dielectric interlayer material characterized as electrically poor by nature of the material or by the loading of the dielectric with lossy pigment, (3) using a laminated interlayer of electrically good and electrically poor dielectrics, or (4) using electrically poor conductors for the sheaths and an electrically good dielectric material.

Some other types of cable have a shield consisting of two layers of cigarette-wrapped aluminum and plastic laminate tape, with a layer of braided aluminum or copper round wires between the laminate tape layers.

It is also known in various types of cable to use an uninsulated metallic drain wire (in electrical contact with the conductive surface of a metallic sheath) to drain off excess current from a sheath, to ground a sheath (especially where the sheath itself has limited current carrying capacity, e.g., where it comprises a thin metallic film), or to provide an easier means to terminate a sheath. Longitudinal drain wires inhibit flexure of the cable and thus preferably are helically wound around the sheath with a very long lay to minimize the amount of wire required while allowing the desired flexibility, as disclosed in Timmons, U.S. Pat. No. 3,032,604. The drain wire may be either exposed, embedded in the dielectric material surrounding the center conductor, or embedded in the jacket material surrounding the metallic sheath. In twisted pair cables having a drain wire inside a coaxial sheath, the lay of the drain wire preferably matches the twisted pair for ease of manufacturing, as shown in U.S. Pat. Nos. 4,096,346, Stine et al.; and 4,041,237, Stine. Drain wires are also disclosed in U.S. Pat. Nos. 4,157,518, McCarthy; 4,323,721, Kincaid, et al.; 4,327,246, Kincaid; and 4,376,920, Smith.

U.S. Pat. No. 3,666,877 Arnaudin, Jr., et al.; disclose embedding a drain conductor in a semi-conducting cable jacket to electrically reinforce the jacket.

In the case of shielded radio frequency radiating cables, a desired degradation of the cable shielding which improves the desired radiation, can be obtained by a wire wound helically onto the outer surface of, and preferably in electrical contact with, a radiating metallic sheath, and may be embedded in the cable jacket. U.S. Pat. No. 3.949,329, Martin; discloses winding the wire on a braid to increase the inductance seen by the leakage wave propagating on the outer surface of the metallic sheath. This increase in inductance is desired to control the velocity of the leakage wave thereby enhancing the performance of the radiating cable. As shown in U.S. Pat. Nos. 3,870,977, peoples et al.; and 4,339,733, Smith; wires may be used on the inner surface of a leaky metallic coaxial sheath to enhance the radiation from apertures in the sheath. These known enhancements of radiation from a radiating cable reflect a desired degradation of cable shielding.

Cables are often mechanically supported by so-called messengers, i.e., tension bearing metal wires embedded in the jacket.

SUMMARY OF THE INVENTION

In general, the invention features a shielded radio frequency transmission cable which significantly attenuates ingressive and egressive coupling of radio frequency energy through the shield by having an inner metallic sheath within which is defined a first transmission path, an outer metallic sheath enclosing and separated from the inner metallic sheath, and a dielectric material and a conductive means disposed in the space between the sheaths and configured to cause the propagation function of a second transmission path, that results within the space between the inner and outer metallic sheaths, to be significantly greater than twice the propagation function of the first transmission path. Preferably the dielectric material is predominant over the conductive means.

The cable of the invention enables enhanced shielding using relatively little metal; permits the use (in the space between the sheaths) of high strength, high flexibility, low weight, economical and even electrically good dielectric materials (for example, polytetrafluoroethylene or polyethylene); may permit decreasing the number and cost of metallic sheaths; and may allow the elimination of metal messengers.

In preferred embodiments, the conductive means in the space defining the second transmission path is at least one continuous metallic uninsulated wire arranged to alter the effective spatial configuration of the second transmission path, by being helically wound along the length of the cable and within the space between the sheaths.

More preferably, the dielectric material and the metallic wire are braided around the inner metallic sheath using a conventional braiding machine to create a braided interlayer between the two metallic sheaths.

Most preferably, at least two carriers of the braid are metallic wires counterwound during braiding so as to cross one another at periodic locations spaced along the length of the cable, such that, for the predominant number of cross-sections taken along the length of the cable, the ratio of the cross-sectional area of the dielectric material in the braided interlayer to the cross-sectional area of the metallic wires in the braided interlayer is at least 9 to 1. The use of the dielectric material enables light weight, and high flexibility, and, in certain circumstances, improved tensile strength. To achieve high temperature performance and improved tensile strength, a high strength insulating material such as Nomex TM, a DuPont high temperature resistant nylon fiber, is used.

From the foregoing, it should be apparent that the cable may take the form of numerous, different embodiments. Any of the known materials and manufacturing processes may be employed for the center conductor, dielectric and at least two metallic sheaths. The crucial feature in all embodiments is the separation of at least two metallic sheaths to raise the series impedance of the path between the sheaths and the use of insulating material, which may be an electrically good dielectric, with at least one conducting member to thereby create a high propagation function for the path between these separated sheaths. This improvement in shielding created by the use of at least one conducting member in the interlayer may be seen as quite surprising considering Martin's and Peoples use of a conducting member to degrade shielding thereby improving desired radiation from a radiating cable as disclosed in referenced U.S. Patents.

In embodiments using a braided interlayer, the dielectric strands permit faster and hence more economical braiding; and the interlayer is easier and cheaper to fabricate than by extrusion. In embodiments in which the conductive means touches the metallic sheath, it may also serve as a drain wire. Where the conductive means includes two members helically wound in opposite directions, the braiding machine can operate in a more balanced manner.

Other advantages and features of the invention will be apparent from the following description of the preferred embodiment, and from the claims.

DESCRIPTION OF THE PREFERRED EMBODIMENTS

We first briefly describe the drawings.

Drawings

STRUCTURE, MANUFACTURE, AND OPERATION

Figure 1:
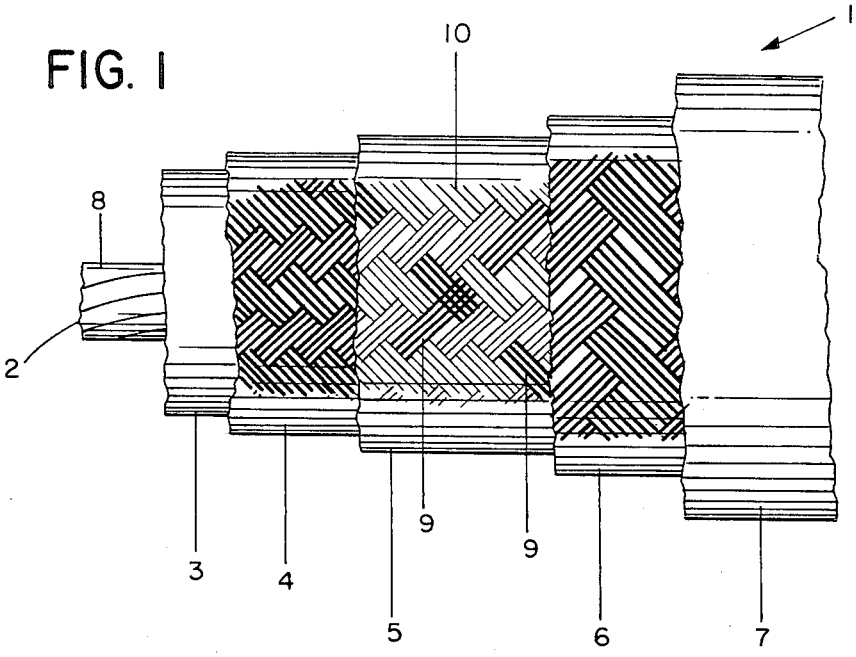
FIG. 1 is a side view (with portions cut away stepwise to expose the different layers) of one embodiment of a cable according to the invention.
Figure 2:
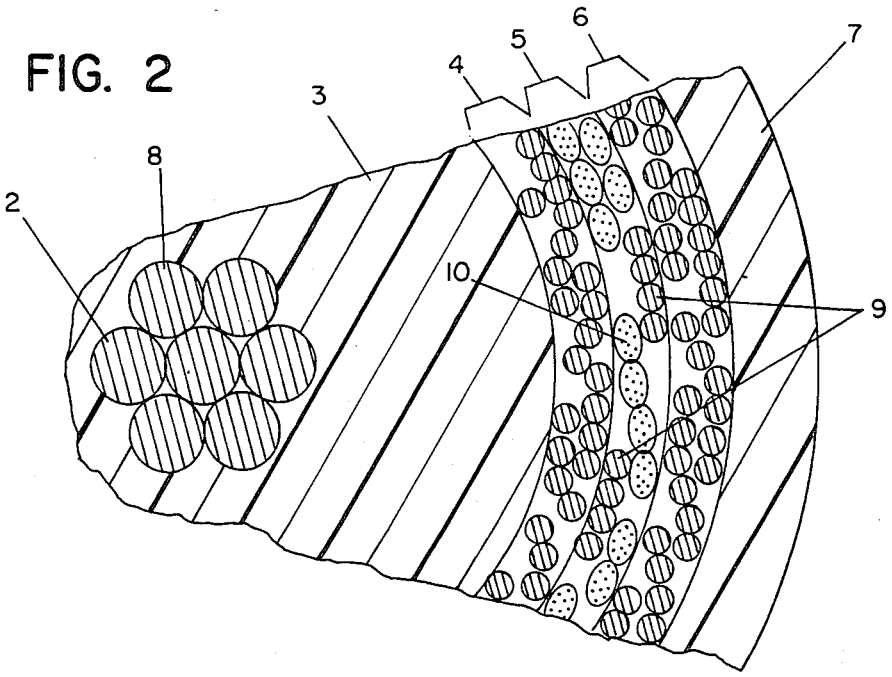
FIG. 2 is of an enlarged representative fragmentary cross-sectional view through the cable of FIG. 1.

Referring to FIGS. 1 and 2, a triaxial cable 1 includes a center conductor 2 (e.g., stranded, silver-plated copper or copper-covered steel wire), surrounded by a cylindrical layer of extruded foamed polyethylene dielectric material 3. Spaced apart inner and outer metallic sheaths 4, 6 are braided copper having 96% optical coverage. Black polyethylene outer jacket 7 is extruded over outer sheath 6. Conductor 2 and sheath 4 define an inner transmission path and spaced apart sheaths 4, 6 result in an outer transmission path along the length of the cable. In the space between sheaths 4, 6 is a unique interlayer 5, comprising a braid of predominantly insulating material 10 (e.g., nylon) with at least one conducting member (metallic carrier) 9. Only a very small percentage (preferably less than 2%) of the transverse cross sectional area of the space between sheaths 42, 6 is represented by conducting members 9 (of which there are two in the embodiment of FIG. 1) while the remaining cross-sectional area is represented by inexpensive dielectric material 10 and air. Dielectric material 10 may be an electrically good insulator with a low dissipation factor and a low dielectric constant. The two conducting members 9 are wound helically in opposite directions, and by virtue of the braiding each conducting member 9 touches the inner sheath 4 and the outer sheath 5 at frequent intervals along the cable. The two conducting members 9 also touch each other at periodic intervals along the cable.

The configuration of interlayer 5 effectively alters the spatial configuration of the outer transmission path, which is thought to cause the outer transmission path to have a very high propagation function (significantly higher than twice the propagation function of the inner transmission path) which combined with a high series impedance results in improved shielding and suppression of electromagnetic interference (EMI) and radio frequency interference (RFI), while keeping low the number and cost of the metallic sheaths and other materials.

Figure 3:
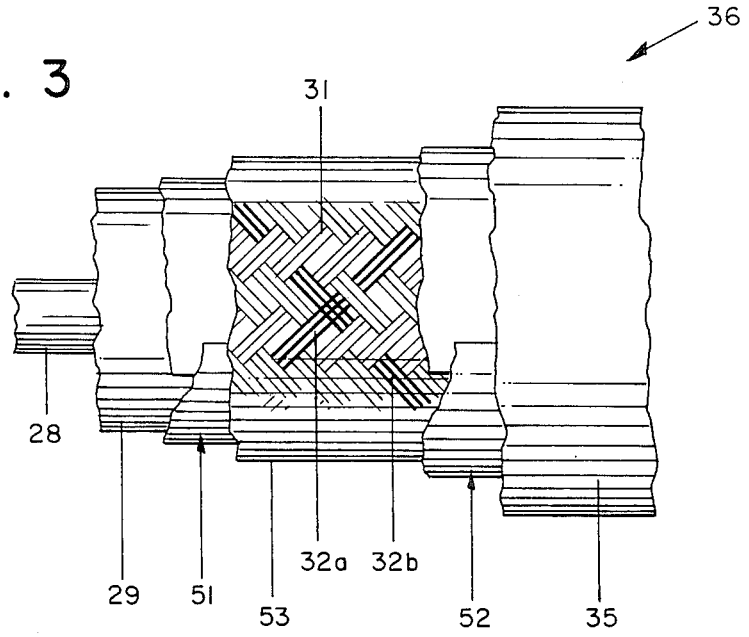
FIGS. 3, 5, 7 are side views of other embodiments.
Figure 4:
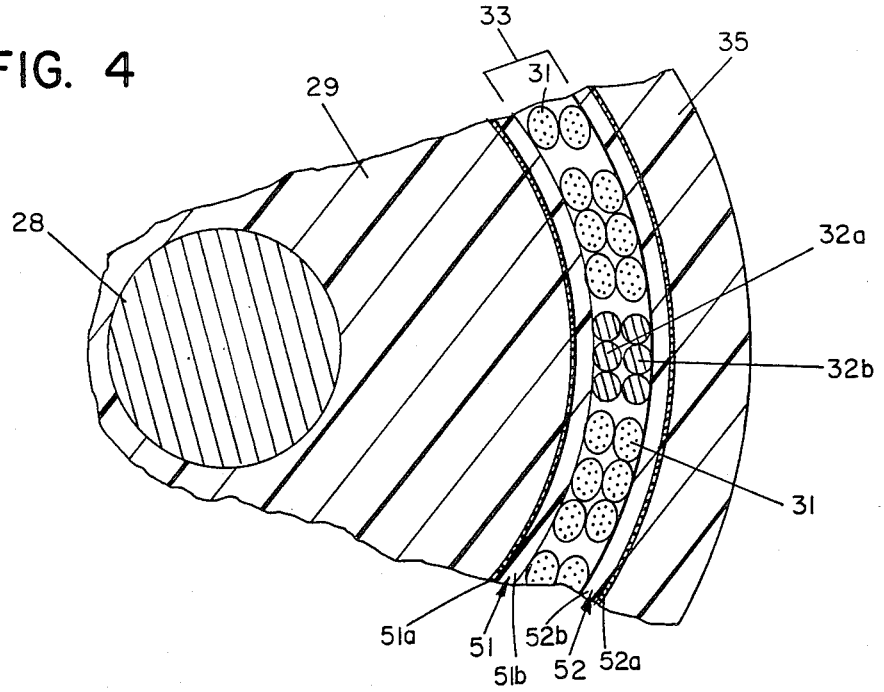
FIGS. 4, 6, 8 are cross-sectional views respectively through the cables of FIGS. 3, 5 and 7.

Referring to FIGS. 3 and 4, another embodiment is shown with center conductor 28 and dielectric 29. Inner and outer metallic sheaths 51, 52 are longitudinally pulled laminate tapes, typically referred to as "cigarette-wrapped" tapes. Jacket 35 encloses outer sheath 52. In accordance with the invention, an interlayer 33 separates metallic sheaths 51 and 52. The interlayer 33 is braided of dielectric carriers 31 and with two aluminum or copper carriers **32*a*, 32*b* by means of a conventional braider machine typically used in the textile and wire industries; the dielectric carriers are predominate over the metal carriers. The tapes which form sheaths 51, 52 can be arranged with their metal layers (51A, 52A) either in electrical contact with or insulated from the interlayer 33, so that metallic strands 32*a*, 32*b* either do not electrically contact sheaths 51, 52, or electrically contact either or both of sheaths 51, 52 at frequent intervals along the cable FIG. 4 shows the metal layers 51A, 52A insulated from the interlayer 33 by the plastic layers 51B, 52B of the laminate tapes 51, 52, so that the metallic strands 32A, 32B of the interlayer 33 do not electrically contact the metal sheaths 51A, 52A. When such electrical contacts are made, the strands 32*a*, 32*b* can serve as drain wires. Preferably the laminate tapes are aluminum-plastic-aluminum with an adhesive on one side. The adhesive adheres the inner tape 51 to dielectric 29, and the outer tape 52 to jacket 35**.

By contrast with the cable of FIGS. 3, 4, a common coaxial braid used for cable television (CATV) has elements corresponding to 28, 29, 51, 52 and 35 of FIGS. 3 and 4, but the braided interlayer (corresponding to element 33) of the CATV cable television cable has sixteen carriers each with three ends, a total of forty-eight 34 AWG aluminum or copper metallic strands and no insulating strands. Interlayer 33, in accordance with a preferred embodiment of the invention, has fourteen dielectric carriers each with three ends, for a total of forty-two insulating non-metallic strands 31 and only two metallic carriers each with three ends, for a total of only six metallic (aluminum or copper) strands **32*a*, 32*b***. Thus, although both the conventional CATV cable and the cable of this preferred embodiment have interlayer braids of forty-eight strands, in the cable of this preferred embodiment only twelve and one half percent (12.5%) of the members are metal. About 30% of the cross-section is air, about 61% is dielectric carriers, and about 9% is metal carriers. Therefore, the ratio of cross-sectional area of dielectric material to cross-sectional area of metallic material is about 10:1.

The choice of the ratio of the cross-sectional area of dielectric material to the cross-sectional area of metallic material in the secondary transmission path reflects tradeoffs between weight (the dielectric material may be lighter), strength (the dielectric material may be stronger), cost (the dielectric material may be cheaper), ease of manufacture (using pairs of metallic carriers makes braiding easier), and shielding. At least a 9 to 1 ratio of dielectric material cross-sectional area to cross-sectional area of the metal material provides a good balance of these considerations.

The invention has a number of advantages beyond Smith, U.S. Pat. No. 4,375,920, and over other prior art cables in that it provides excellent shielding while incorporating the use of nonmetallic high-strength members in the braided interlayer to significantly increase the longitudinal strength of the cable without decreasing its flexibility. A braided interlayer according to the invention may be more flexible than an extruded interlayer and more flexible than known cables with metallic braids between two laminate tapes. The braided interlayer of preferred embodiments of the invention may have a lighter weight than known cables with all metal braided interlayers. Nonmetallic members in the interlayer may be chosen which are significantly less expensive, and may be braided at a higher speed. The decreased material costs and increased speed of manufacture result in a manufacturing cost lower than the prior art metallic braids. The increased braider speed also decreases the capital equipment and overhead costs, for any given production level, to further reduce cable manufacturing costs.

In embodiments in which the metallic members 32*a*, 32*b* (FIGS. 3, 4) are in electrical contact with at least one of the metallic sheaths 51, 52, another advantage is the elimination of the separate longitudinal drain wires normally required with laminate tapes. Instead, the metallic members 32*a*, 32*b* in the braided interlayer 33 establish the electrical connection and function as drain wires. These metallic members 32*a*, 32*b* also reduce the low frequency resistance of the metallic sheath and drain off current which exceeds the current carrying capacity of the tape.

In one example of cable which has been manufactured in accordance with the principles of FIG. 1, the conventional center conductor 2 has seven strands 8 of 0.032 inch diameter silver-plated copper wire. Dielectric layer 3 is taped polytetrafluoroethylene having a 0.260 inch outer diameter. Inner metallic sheath 4 is 96% optical coverage, silver-plated, copper strip braid with a 0.275 inch outer diameter. Interlayer 5, manufactured with a conventional braiding machine, has a 0.308 inch outer diameter, thirty-four (34) carriers each having 6 strands (ends) of 200 denier, 5.3 grams per denier breaking tenacity, high temperature resistant nylon fiber 10 and two (2) carriers each having 9 ends of 34 AWG silver-plated copper wire 9. Interlayer 5 is a braid of 17.5 picks, so that the contact points between each metal carrier and each sheath occur about every 0.1 inches along the length of the cable and the contact points between the two metal carriers occur about every 1 inch along the length of the cable. The outer metallic sheath 6 is a 96% optical coverage, silver-plated, copper 34 AWG braid with a 0.335 inch outer diameter. The jacket 7 is extruded fluorinated ethylene propylene with a 0.360 inch outer diameter.

This cable example is characterized by a significant measured improvement of 10 db to 30 db in RFI (radio frequency interference) shielding over a prior art triaxial cable which was identical to the cable example with the exception that interlayer 5 was made entirely with braided high temperature resistant nylon fiber (distributed by DuPont under the name Nomex TM); that is, the volume occupied by the silver-plated copper carriers 9 in FIG. 1 was instead occupied by Nomex. This embodiment thus achieved both the advantages foreseen by Smith and the advantages not heretofore known of being readily and inexpensively fabricated.

For further comparison, another cable sample was also manufactured and was identical to the cable example described above with the sole exception of having no interlayer 5 between the metal sheaths 4, 6; that is, sheath 6 was placed directly onto sheath 4. Sheath 6 and jacket 7 had smaller diameters as required by eliminating interlayer 5. Shielding measurements show that the sample cable (with interlayer 5) provided a 12 db to 15 db improvement over the cable which lacked interlayer 5.

Figure 5:
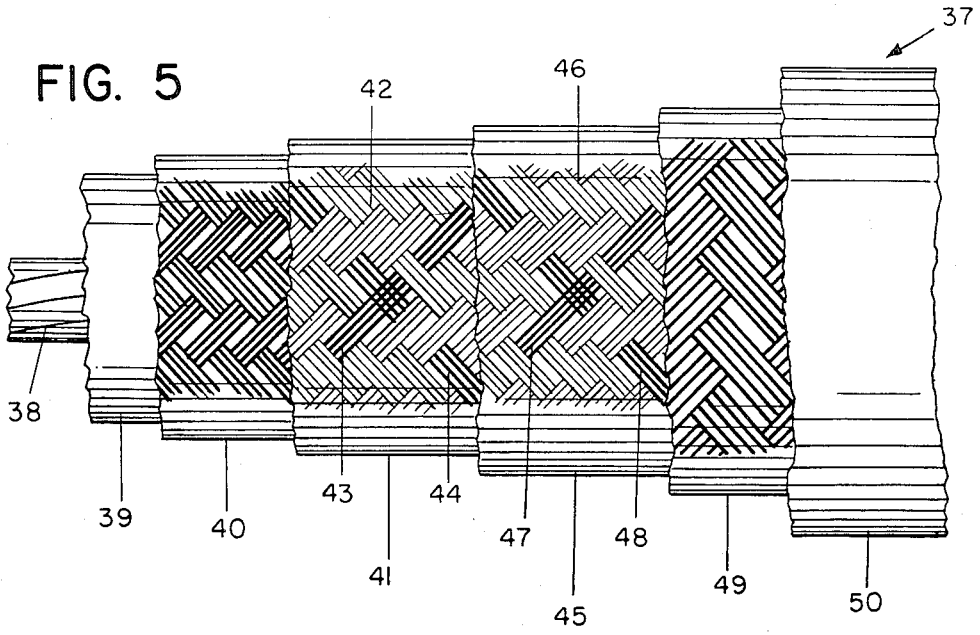
Figure 6:
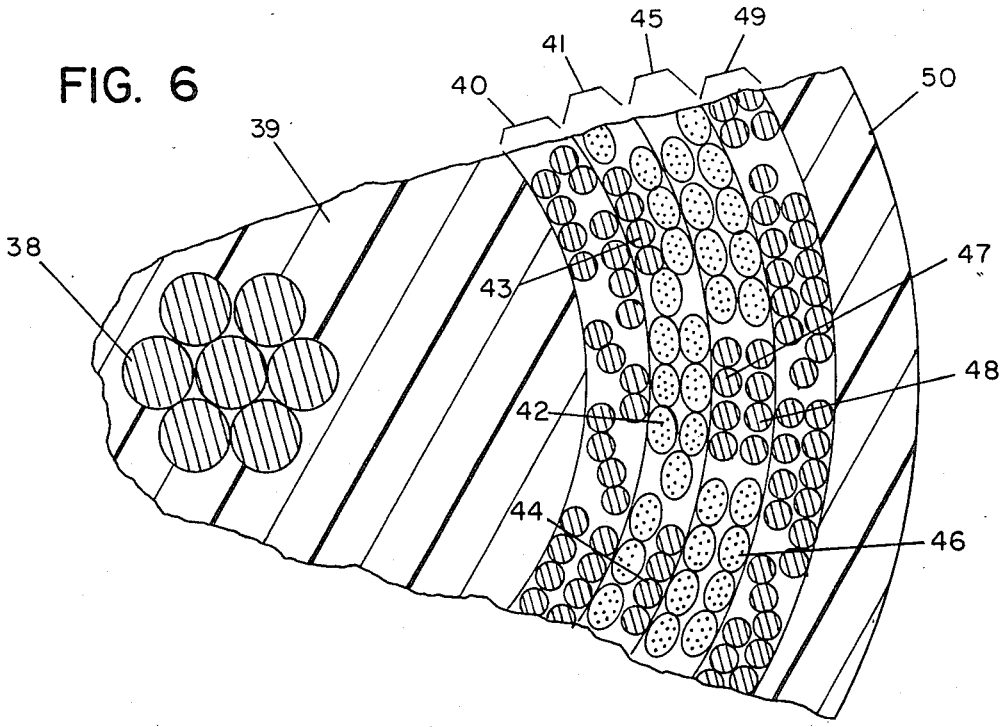

Referring to FIGS. 5 and 6, another embodiment is shown where center conductor 38, dielectric 39, metallic sheath 40, and interlayer 41 are the same as in the cable in FIG. 1. Metallic sheath 49 and jacket 50 are similar to, but have larger diameters than, sheath 6 and jacket 7 of FIG. 1. A second interlayer 45 is the only difference from FIG. 1. Interlayer 45 is the same as interlayer 41 except larger in diameter.

Figure 7:
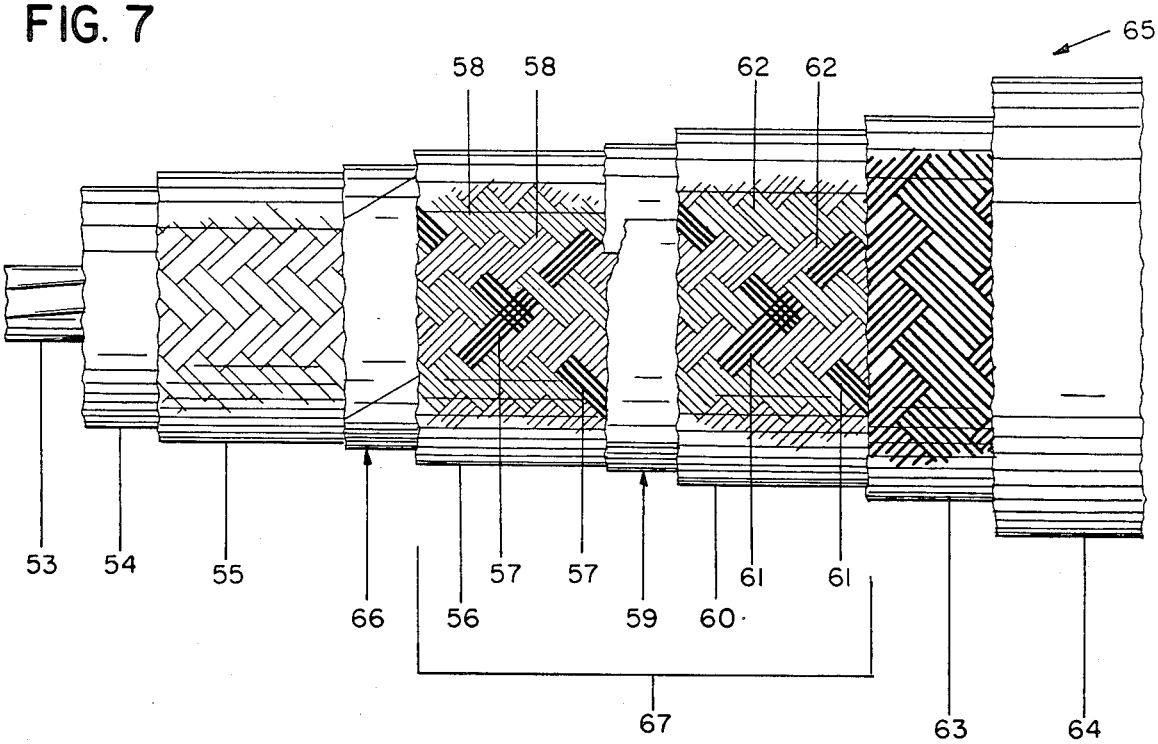
Figure 8:
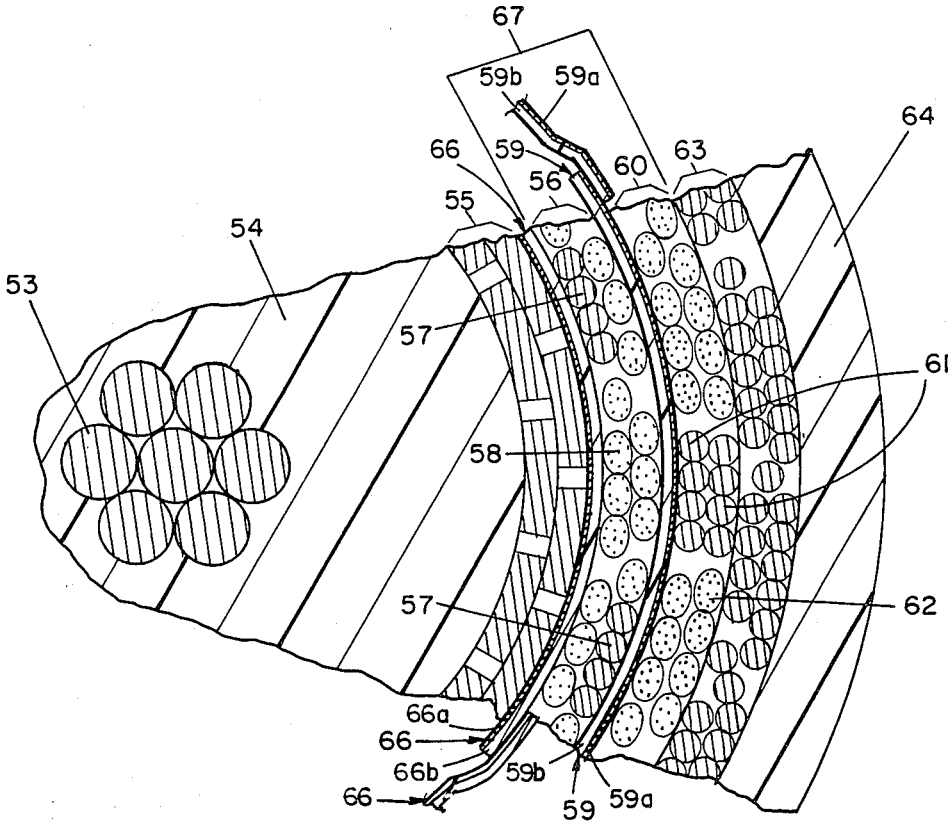

Referring to FIGS. 7 and 8, the most preferred embodiment is shown. Cable 65 includes center conductor 53, dielectric 54, metallic strip braided inner sheath 55, helically wrapped metal-plastic laminate tape inner sheath 66, interlayer assembly 67, metallic braided outer sheath 63, and jacket 64. There are two braided interlayers 56, 60 in interlayer assembly 67. Each interlayer 56 and 60 consists of braided insulating material 58, 62 with at least one conducting member 57, 61 respectively (two are shown in FIGS. 7 and 8) included in each braid. A third metallic sheath 59, added between interlayers 56, 60, further improves RFI shielding; metallic sheath 59 is a longitudinally pulled "cigarette-wrapped" metal-plastic laminate tape. FIG. 8 shows the metal layers 66A, 59A insulated from the interlayer 56 by the plastic layers 66B, 59B of the laminate tapes 66, 59, so that the metallic strands 57 of the interlayer 56 do not electrically contact the metal sheaths 66A, 59A.

Other embodiments are also within the following claims. For example, each strand of the conducting members in the braided interlayer may be coated with insulation to enable it to carry a signal; there need only be a single helically wrapped conducting element in the space between the metallic sheaths; and the conducting member could be a single wire of a diameter which substantially spans the space between the two metal sheaths, but without making electrical contact with the metal sheaths.

Although the exact principle of operation of the cable is not entirely certain, plausible explanations can be offered.

In embodiments having a single wire with a tight pitch helically wound in the interlayer, the wire apparently alters the transmission path so that longitudinal current flow is distorted into a helical current flow which increases the series resistance and inductance, thus increasing the propagation function of the outer transmission path.

In cases where two interlayer wires are wound helically in opposite directions, the above effect may be eliminated because the periodic crossing of the two wires may cancel the additional inductances. However, the cross wires in effect are seen to produce a succession of resonant cavities each with a very short longitudinal propagation path, thus increasing the propagation function.

In cases where a thick interlayer wire spans substantially the entire space between the metallic sheaths, the wire in effect short circuits the transmission path, thus almost eliminating the dielectric channel for propagation of the wave, thus increasing the propagation function.

I claim:

1. A cable comprising
at least one center conductor,
a generally cylindrical dielectric means surrounding said center conductor,
an inner metallic sheath generally concentric with said center conductor and surrounding said dielectric to contain electromagnetic fields and to define a transmission path within said sheath for transmission of radio-frequency signals with a relatively low propagation function,
at least one outer metallic sheath surrounding and separated from said inner metallic sheath to define a second transmission path between said inner and outer metallic sheaths,
the space between said separated metallic sheaths containing a dielectric material and an electrically conductive enhancing means, said dielectric material filling a predominate portion of said space,
said electrically conductive enhancing means being configured to increase the propagation function of said transmission path between said inner and outer metallic sheaths to a value significantly greater than twice said low propagation function of said transmission path within said inner metallic sheath.

2. The cable of claim 1 wherein the electrically conductive enhancing means is arranged to alter the effective spatial configuration of the second transmission path.

3. The cable of claim 1 wherein the electrically conductive enhancing means is helically wound within the space between the sheaths.

4. The cable of claim 1 wherein the space between the inner and outer metallic sheaths contains a braided layer, said electrically conductive enhancing means is at least one metallic wire in said braided layer and said dielectric material is strands of dielectric material in said braided layer.

5. The cable of claim 3 wherein said dielectric material and said electrically conductive enhancing means in said space between said sheaths comprise an interlayer having a plurality of braided strands including a conductive strand and a multiplicity of dielectric strands.

6. The cable of claim 1 wherein on average the ratio of the cross-sectional area of the dielectric material to the cross-sectional area of the electrically conductive enhancing means at any point along the cable is at least 9.

7. The cable of claim 1 wherein at least one of the metallic sheaths comprises a metal and plastic laminated tape having a metal layer formed on a plastic layer.

8. The cable of claim 1 wherein at least one of the metallic sheaths comprises a metallic braid.

9. The cable of claim 1 wherein the electrically conductive enhancing means comprises metallic wire in the space between the sheaths.

10. The cable of claim 1 wherein said electrically conductive enhancing means comprises insulated metallic wire in said space.

11. The cable of claim 5 wherein the dielectric material comprises high temperature resistant braided strands.

12. The cable of claim 1 wherein said electrically conductive enhancing means further comprises an intermediate metallic sheath coaxial with, positioned between, and separated from each of, the outer and inner metallic sheaths.

13. The cable of claim 1 wherein one of the metallic sheaths comprises helically wound metallic tape.

14. The cable of claim 1 wherein the electrically conductive enhancing means is continous along the length of the cable.

15. The cable of claim 1 wherein the dielectric material has a low dissipation factor and a low dielectric constant.

16. The cable of claim 1 wherein the electrically conductive enhancing means makes electrical contact with a surface of at least one of the metallic sheaths.

17. The cable of claim 16 wherein the electrically conductive enhancing means makes electrical contact to the surface of each metallic sheath at a plurality of points spaced along the length of the cable.

18. The cable of claim 1 wherein the electrically conductive enhancing means does not make electrical contat with the sheaths.

19. A shielded radio frequency transmission cable having
a center conductor,
a dielectric material surrounding the center conductor,
a braided metallic inner sheath surrounding the dielectric material,
a braided metallic outer sheath surrounding, coaxially with, and spaced from the inner sheath, and
an interlayer in the space between the sheaths, the interlayer comprising a plurality of braided strands including
a multiplicity of strands of insulating material, and at least one strand of conductive material.

20. A shielded radio frequency transmisssion cable comprising in coaxial relationship:
a center conductor,
a dielectric material surrounding the center conductor,
an inner metallic sheath surrounding the dielectric material,
an inner braided interlayer surrounding the inner metallic sheath,
an intermediate metallic sheath surrounding the inner braided interlayer,
an outer braided interlayer surrounding the intermediate metallic sheath, and
an outer metallic sheath surrounding the outer braided interlayer,
and wherein at least one of the interlayers comprises strands of insulating material and at least one electrically conductive strand with the aggregate transverse cross-sectional area of the strands of the interlayer comprised predominantly of the insulating material.

21. The cable of claim 20 further comprising an additional inner metallic sheath surrounding the inner metallic sheath and surrounded by the inner braided interlayer, and wherein the inner metallic sheath comprises a braid of metal strips, the additional inner metallic sheath comprises a helically wrapped metal-plastic laminate tape, the strands of insulating material comprise high temperature resistant nylon fibers, and the electically conductive strands comprise metal, the intermediate metallic sheath comprises a longitudinally pulled metal-plastic laminate tape, and the outer metallic sheath comprises a braid of round metallic wires.

22. The cable of claim 14 further comprising an additional inner metallic sheath surrounding the inner metallic sheath and surrounded by the braided interlayer, and wherein the metallic inner sheath comprises a braid of metallic strips, the additional metallic inner sheath comprises a helically wrapped metal-plastic laminate tape, the strands of insulating material of the braided interlayer comprises high temperature resistant nylon fibers, the conductive material comprises metal, and the metallic outer sheath comprises a braid of round metal wires.

23. The cable of claim 21 or 22 further comprising an outer jacket of insulating material surrounding the outer sheath.

* * * * *

UNITED STATES PATENT AND TRADEMARK OFFICE

CERTIFICATE OF CORRECTION

PATENT NO. : 4,641,110

DATED : February 3, 1987

INVENTOR(S) : Kenneth L. Smith

It is certified that error appears in the above-identified patent and that said Letters Patent are hereby corrected as shown below:

Under REFERENCES CITED, last U.S. patent cited, "Kralec et al." should be --Krabec et al.--;

Col. 1, line 61, after "3,666,877", insert a comma; same line, delete the semicolon after "et al." and insert a comma instead;

Col. 2, line 2, delete the semicolon after "Martin" and insert a comma instead;

Col. 2, line 8, "peoples et al.;" should be --Peoples et al.,--;

Col. 2, line 9, delete the semicolon after "Smith" and insert a comma instead;

Col. 3, line 63, "42,6" should be --4,6--;

Col. 4, line 57, insert a comma after "31";

Col. 8, line 15, claim 14, "continous" should be --continuous--;

Col. 8, line 29, claim 18, "contat" should be --contact--.

Signed and Sealed this

Eighth Day of December, 1987

*Attest:*

DONALD J. QUIGG

*Attesting Officer*

*Commissioner of Patents and Trademarks*